US008092177B2

(12) United States Patent
Liang

(10) Patent No.: US 8,092,177 B2
(45) Date of Patent: Jan. 10, 2012

(54) TURBINE AIRFOIL COOLING SYSTEM WITH DIFFUSION FILM COOLING HOLE HAVING FLOW RESTRICTION RIB

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 595 days.

(21) Appl. No.: 12/338,331

(22) Filed: Dec. 18, 2008

(65) Prior Publication Data

US 2010/0068068 A1 Mar. 18, 2010

Related U.S. Application Data

(60) Provisional application No. 61/097,332, filed on Sep. 16, 2008.

(51) Int. Cl.

| | |
|---|---|
| ***B63H 1/14*** | (2006.01) |
| ***B63H 7/02*** | (2006.01) |
| ***B63H 1/28*** | (2006.01) |
| ***B64C 11/00*** | (2006.01) |
| ***B64C 11/16*** | (2006.01) |
| ***F01D 5/08*** | (2006.01) |
| ***F01D 5/18*** | (2006.01) |
| ***F01D 5/20*** | (2006.01) |
| ***F01D 5/14*** | (2006.01) |
| ***F03D 11/02*** | (2006.01) |
| ***F04D 29/58*** | (2006.01) |

(52) U.S. Cl. ..... 416/96 R; 416/97 R; 416/231 R

(58) Field of Classification Search ..... 416/96 R, 416/97 R, 231 R

See application file for complete search history.

(56) References Cited

U.S. PATENT DOCUMENTS

| | | | | |
|---|---|---|---|---|
| 4,653,983 | A | 3/1987 | Vehr | |
| 4,684,323 | A | 8/1987 | Field | |
| 5,062,768 | A * | 11/1991 | Marriage | 416/97 R |
| 5,382,133 | A | 1/1995 | Moore et al. | |
| 6,183,199 | B1 | 2/2001 | Beeck et al. | |
| 6,869,268 | B2 | 3/2005 | Liang | |
| 6,918,742 | B2 | 7/2005 | Liang | |
| 7,997,868 | B1 * | 8/2011 | Liang | 416/97 R |

* cited by examiner

*Primary Examiner* — David Zarneke

(57) ABSTRACT

A cooling system for a turbine airfoil of a turbine engine having at least one diffusion film cooling hole positioned in an outer wall defining the turbine airfoil is disclosed. The diffusion film cooling hole includes first and second sections. The first section may function as a metering section, and the second section may function as a diffusion section. The second section may include flow restriction ribs that direct the flow of cooling fluids in disproportionately larger amounts proximate to the downstream side of the diffusion film cooling hole.

20 Claims, 6 Drawing Sheets

TURBINE AIRFOIL COOLING SYSTEM WITH DIFFUSION FILM COOLING HOLE HAVING FLOW RESTRICTION RIB

CROSS-REFERENCE TO RELATED APPLICATION

This patent application claims the benefit of U.S. Provisional Patent Application No. 61/097,332, filed Sep. 16, 2008, which is incorporated by reference in its entirety.

FIELD OF THE INVENTION

This invention is directed generally to turbine airfoils, and more particularly to cooling systems in hollow turbine airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies and turbine vanes to these high temperatures. As a result, turbine airfoils must be made of materials capable of withstanding such high temperatures. In addition, turbine airfoils often contain cooling systems for prolonging the life of the turbine airfoils and reducing the likelihood of failure as a result of excessive temperatures.

Typically, turbine airfoils contain an intricate maze of cooling channels forming a cooling system. Turbine airfoils include turbine blades and turbine vanes. Turbine blades are formed from a root portion having a platform at one end and an elongated portion forming a blade that extends outwardly from the platform coupled to the root portion. The blade is ordinarily composed of a tip opposite the root section, a leading edge, and a trailing edge. Turbine vanes have a similar configuration except that a radially outer and is attached to a shroud and a radially inner end meshes with a rotatable rotor assembly. The cooling channels in a turbine airfoil receive air from the compressor of the turbine engine and pass the air through the airfoil. The cooling channels often include multiple flow paths that are designed to maintain all aspects of the turbine airfoil at a relatively uniform temperature. However, centrifugal forces and air flow at boundary layers often prevent some areas of the turbine airfoil from being adequately cooled, which results in the formation of localized hot spots. Localized hot spots, depending on their location, can reduce the useful life of a turbine airfoil and can damage a turbine blade to an extent necessitating replacement of the airfoil.

In one conventional cooling system, diffusion orifices have been used in outer walls of turbine airfoils. Typically, the diffusion orifices are aligned with a metering orifices that extends through the outer wall to provide sufficient cooling to turbine airfoils. The objective of the diffusion orifices is to reduce the velocity of the cooling fluids to create an effective film cooling layer. Nonetheless, many conventional diffusion orifices are configured such that cooling fluids are exhausted and mix with the hot gas path and become ineffective. In addition, as shown in FIGS. 1 and 2, the diffusion orifices often suffer from hot gas ingestion at upstream surfaces of the orifices. The hot gas ingestion causes shear mixing of the hot gases with the cooling fluids, which results in a reduction of film cooling effectiveness. Further, the diffusion orifices also suffer from separation at the downstream surface at the intersection between the change in angle of the linear surfaces forming the downstream surface.

SUMMARY OF THE INVENTION

This invention relates to a turbine airfoil cooling system for a turbine airfoil used in turbine engines. In particular, the turbine airfoil cooling system is directed to a cooling system having an internal cavity positioned between outer walls forming a housing of the turbine airfoil. The cooling system may include a diffusion film cooling hole in the outer wall that may be adapted to receive cooling fluids from the internal cavity, meter the flow of cooling fluids through the diffusion film cooling hole, and release the cooling fluids into a film cooling layer proximate to an outer surface of the airfoil. The diffusion film cooling hole may be curved and include an ever increasing cross-sectional area across that allow cooling fluids to diffuse to create better film coverage and yield better cooling of the turbine airfoil. The diffusion film cooling hole may also include one or more flow restriction ribs that direct the flow to minimize hot gas ingestion and to foster cooling fluid film creation at the outer surface.

The turbine airfoil may be formed from a generally elongated airfoil having a leading edge, a trailing edge and at least one cavity forming a cooling system in the airfoil. An outer wall forming the generally elongated airfoil may have at least one diffusion film cooling hole positioned in the outer wall and providing a cooling fluid pathway between the at least one cavity forming the cooling system and an environment outside of the airfoil. The diffusion film cooling hole may include a first section extending from an inlet into the outer wall and a second section extending from the first section and terminating at an outlet on an outer surface of the outer wall. The second section may have an ever increasing cross-sectional area moving from the first section to the outlet. The first section may have any appropriate cross-sectional configuration, and in at least one embodiment, may have a constant cross-sectional area and function as a metering device. A ratio of length to orthogonal distance of the first section may be between about 1.5:1 to 2.5:1.

At least one flow restriction rib may be positioned in the second section and extend in a direction generally from the first section towards the outlet. The flow restriction rib may be tapered having a wider leading edge closer to the first section than trailing edge that is closer to the outlet. As such, the flow restriction rib enables the cooling fluids to diffuse such that the velocity of the cooling fluids is reduced. The flow restriction rib may also be tapered with a wider outward edge than inward edge. As such, a larger portion of the cooling fluid flow flows proximate to the inward surface, which creates a better cooling film immediately proximate the outer surface of the outer wall. In at least one embodiment, the diffusion film cooling hole may include a plurality of flow restriction ribs. The plurality of flow restriction ribs may be positioned generally beside each other, and a first flow restriction rib may extend closer to the first section than the other flow restriction ribs.

The diffusion film cooling hole may be configured such that an inward surface of the second section may be curved away from a longitudinal axis of the at least one diffusion film cooling hole to increase the size of the outlet. The inward surface of the second section may be curved away from the longitudinal axis of the at least one diffusion film cooling hole such that the curved inward surface begins at the first section and an intersection of the inward surface and the outer surface of the outer wall may be positioned between about 15 degrees and about 25 degrees from the longitudinal axis. Similarly, a first side surface of the second section may be curved away from a longitudinal axis of the at least one diffusion film cooling hole, and a second side surface of the second section that is generally opposite to the first side surface may be curved away from the longitudinal axis of the at least one diffusion film cooling hole. In particular, the first side surface of the second section may be curved away from the longitudinal axis of the at least one diffusion film cooling hole such that the curved first side surface begins at the first section and an outermost point of the first side surface is positioned between about 7 degrees and about 15 degrees from the longitudinal axis. The second side surface of the second section may be curved away from the longitudinal axis of the at least one diffusion film cooling hole such that the curved first side surface begins at the first section and an outermost point of the second side surface is positioned between about 7 degrees and about 15 degrees from the longitudinal axis.

In another embodiment, the diffusion film cooling hole may be positioned such that the longitudinal axis of the diffusion film cooling hole may be at an angle with the direction of flow of the hot gases outside of the turbine airfoil. In particular, the diffusion film cooling hole may be positioned nonparallel and nonorthogonal to a direction aligned with the streamwise flow of the hot gases. The first side surface of the second section may be curved away from the longitudinal axis of the at least one diffusion film cooling hole such that the curved first side surface begins at the first section and an outermost point of the first side surface is positioned between about 0 degrees and about 7 degrees from the longitudinal axis. The second side surface of the second section may be curved away from the longitudinal axis of the at least one diffusion film cooling hole such that the curved first side surface begins at the first section and an outermost point of the second side surface is positioned between about 15 degrees and about 25 degrees from the longitudinal axis.

During operation, cooling fluids, such as gases, are passed through the cooling system. In particular, cooling fluids may pass into the internal cavity by entering the inlet and enter the first section in which the flow of cooling fluids is metered. The cooling fluids then pass into second section and begin to diffuse whereby the velocity of the cooling fluids is reduced. The cooling fluids pass through the openings created by the flow restriction ribs where larger fluid flow occurs proximate to the inward surface than the outward surface. As such, the cooling fluids form a more efficient film and invasion into the hot gas flow path is limited. Therefore, the diffusion film cooling hole minimizes film layer shear mixing with the hot gas flow and thus, yields a higher level of cooling fluid effectiveness.

An advantage of the diffusion film cooling hole is that the divergent cooling hole includes curved divergent side walls configured to create efficient use of cooling fluids in forming film cooling flows.

Another advantage of the diffusion film cooling hole is that the flow restriction ribs direct cooling fluids against the inward surface, thereby forming a more efficient film with reduced effects on the hot gas flow.

Yet another advantage of the diffusion film cooling hole is a larger outlet at the outer surface of the outer wall is created by the first and second sidewalls and the inward surface being curved, which enables cooling fluids to spread out in multiple directions.

Another advantage of the diffusion film cooling hole is that the flow restriction ribs eliminate hot gas ingestion at the upstream side of the outlet.

Still another advantage of the diffusion film cooling hole is that the diffusion film cooling hole has reduced stress concentrations where the surfaces of the second section intersect with the outer surface of the outer wall because of the elimination of sharp corners at the intersection.

Yet another advantage of the diffusion film cooling hole is that the configuration of the diffusion film cooling hole does not include a sharp corner within the hole at the intersection between the first and second sections, thereby preventing flow separation.

Another advantage of the diffusion film cooling hole is that the diffusion film cooling hole exhausts cooling fluids at a lower angle than conventional configurations, thereby forming a better film layer and higher film effectiveness.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
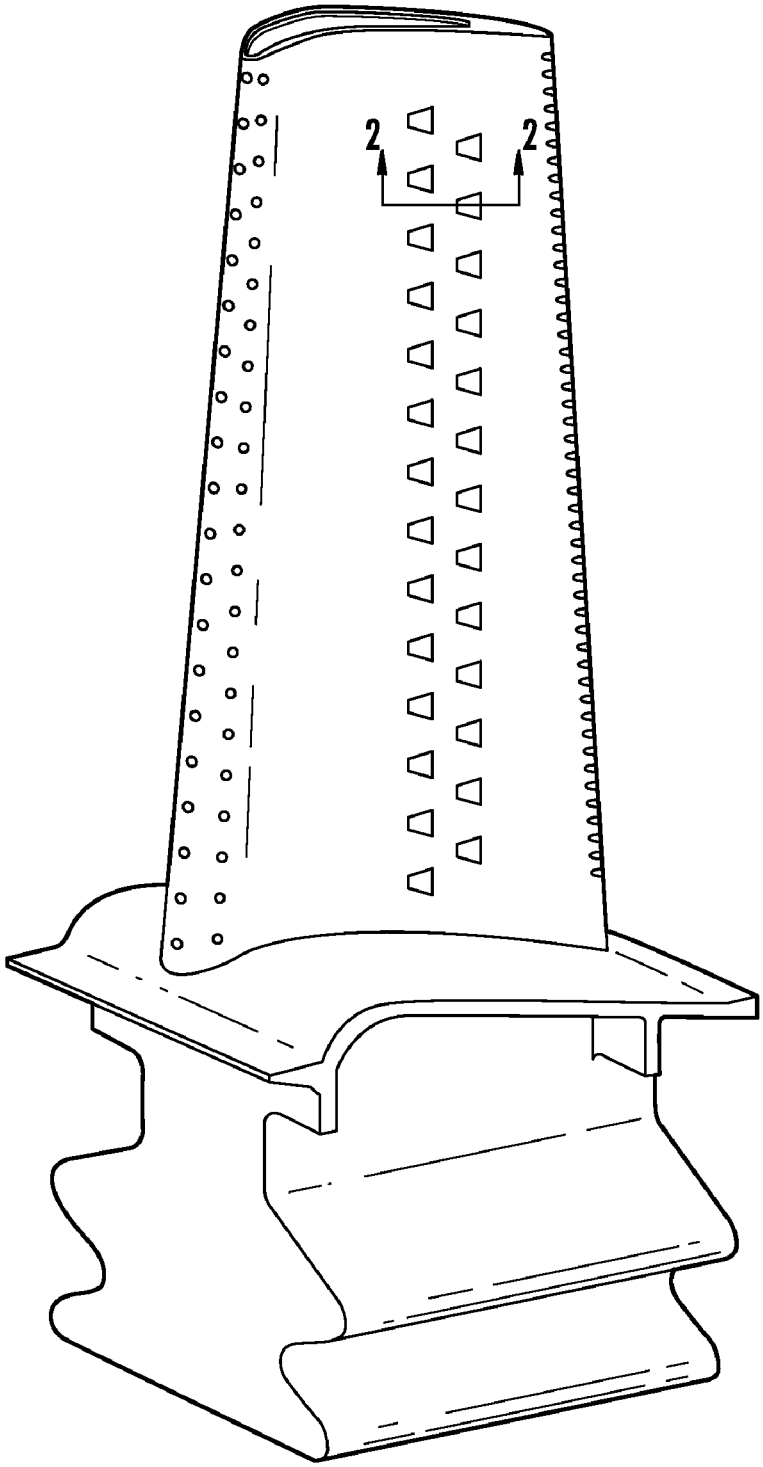
FIG. 1 PRIOR ART
FIG. 1 is a perspective view of a conventional turbine airfoil.
Figure 2:
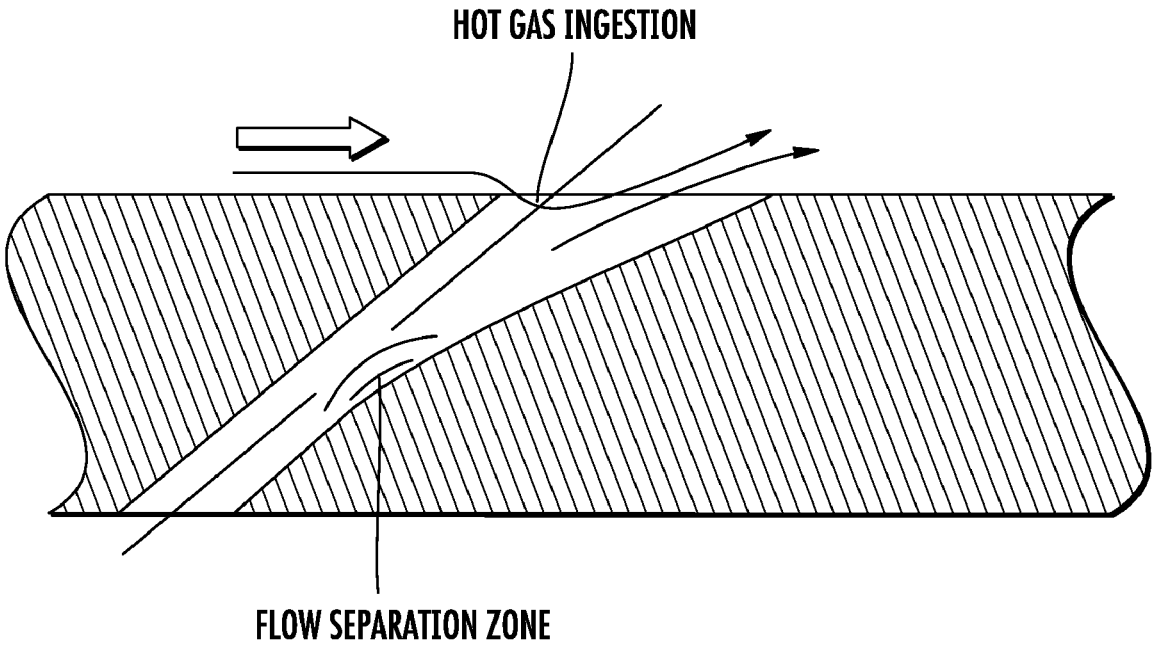
FIG. 2 PRIOR ART
FIG. 2 is cross-sectional, detailed view of a perspective view of a conventional exhaust orifice shown in FIG. 1 taken along section line 2-2.
Figure 3:
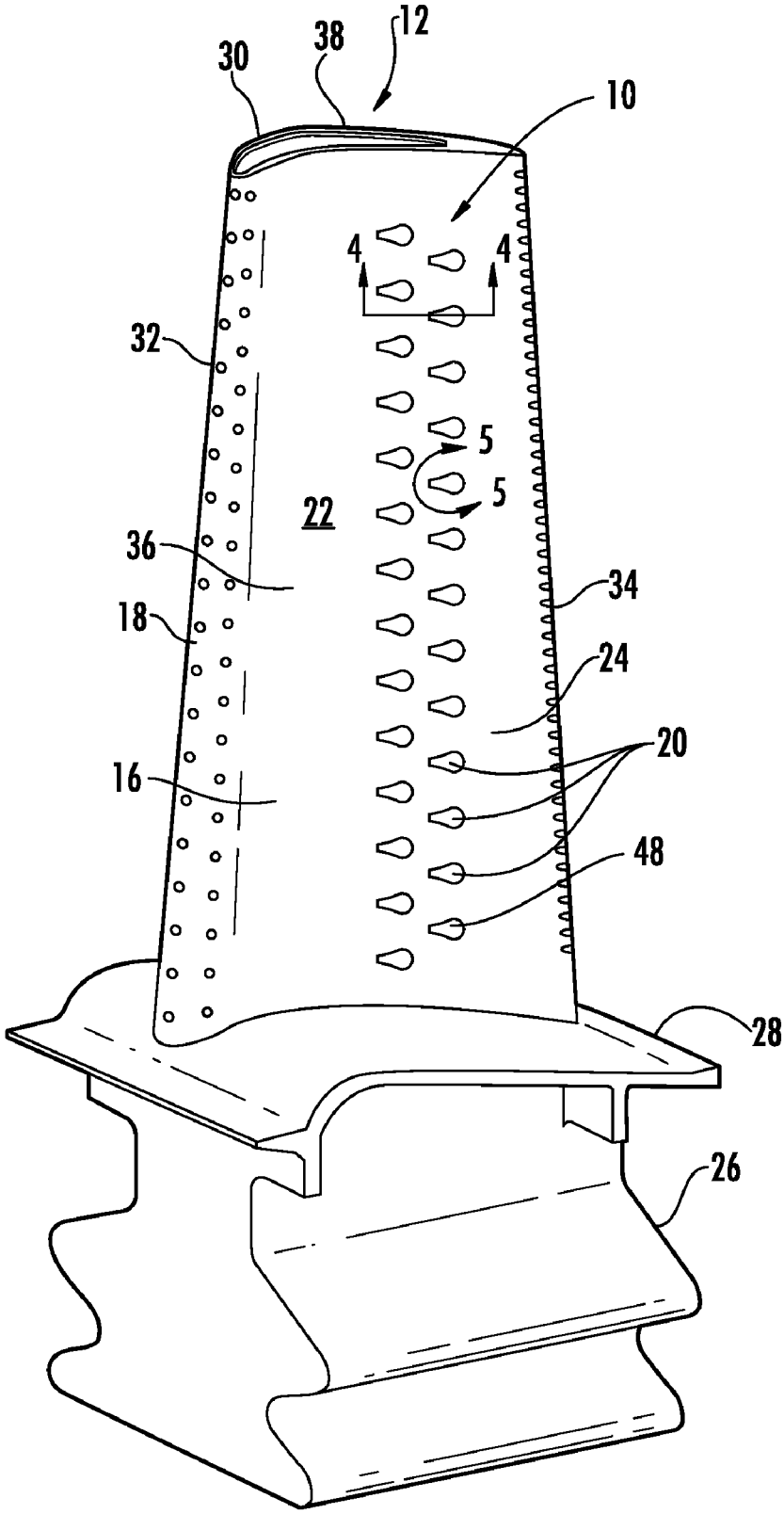
FIG. 3 is a perspective view of a turbine airfoil having features according to the instant invention.
Figure 4:
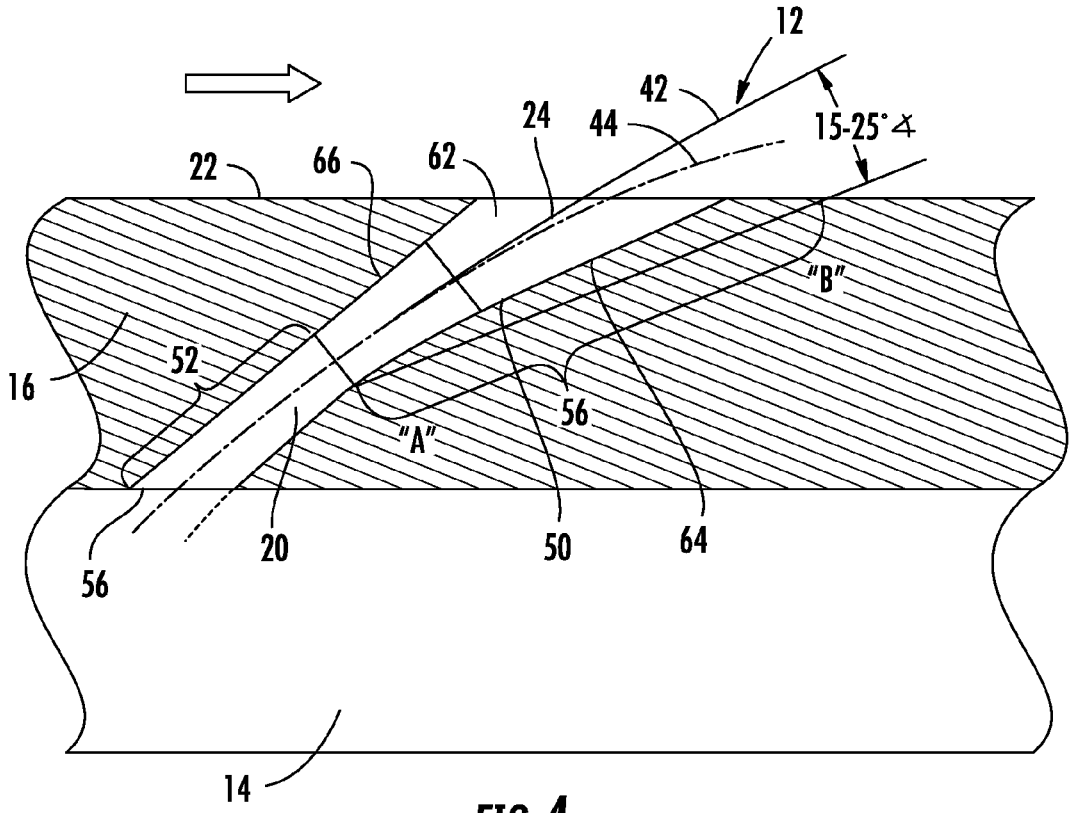
FIG. 4 is cross-sectional, detailed view, referred to as a filleted view, of a diffusion film cooling hole of the turbine airfoil shown in FIG. 3 taken along section line 4-4.

As shown in FIGS. 3-8, this invention is directed to a turbine airfoil cooling system 10 for a turbine airfoil 12 used in turbine engines. In particular, the turbine airfoil cooling system 10 is directed to a cooling system 10 having an internal cavity 14, as shown in FIG. 4, positioned between outer walls 16 forming a housing 18 of the turbine airfoil 12. The cooling system 10 may include a diffusion film cooling hole 20 in the outer wall 16 that may be adapted to receive cooling fluids from the internal cavity 14, meter the flow of cooling fluids through the diffusion film cooling hole 20, and release the cooling fluids into a film cooling layer proximate to an outer surface 22 of the airfoil 12. The diffusion film cooling hole 20 may be curved and include an ever increasing cross-sectional area that allows cooling fluids to diffuse to create better film coverage and yield better cooling of the turbine airfoil. The diffusion film cooling hole 20 may also include one or more flow restriction ribs 24 that direct the flow to minimize hot gas ingestion and to foster cooling fluid film creation at the outer surface 22.

The turbine airfoil 12 may be formed from a generally elongated airfoil 25. The turbine airfoil 12 may be a turbine blade, a turbine vane or other appropriate structure. In embodiments in which the turbine airfoil 12 is a turbine blade, the airfoil 25 may be coupled to a root 26 at a platform 28. The turbine airfoil 12 may be formed from other appropriate configurations and may be formed from conventional metals or other acceptable materials. The generally elongated airfoil 25 may extend from the root 26 to a tip 30 and include a leading edge 32 and trailing edge 34. Airfoil 25 may have an outer wall 16 adapted for use, for example, in a first stage of an axial flow turbine engine. Outer wall 16 may form a generally concave shaped portion forming a pressure side 36 and may form a generally convex shaped portion forming a suction side 38. The cavity 14, as shown in FIG. 4, may be positioned in inner aspects of the airfoil 25 for directing one or more gases, which may include air received from a compressor (not shown), through the airfoil 25 and out one or more holes 20, such as in the leading edge 32, in the airfoil 25 to reduce the temperature of the airfoil 25 and provide film cooling to the outer wall 16. As shown in FIG. 3, the orifices 20 may be positioned in a leading edge 32, a tip 30, or outer wall 16, or any combination thereof, and have various configurations. The cavity 14 may be arranged in various configurations and is not limited to a particular flow path.

Figure 5:
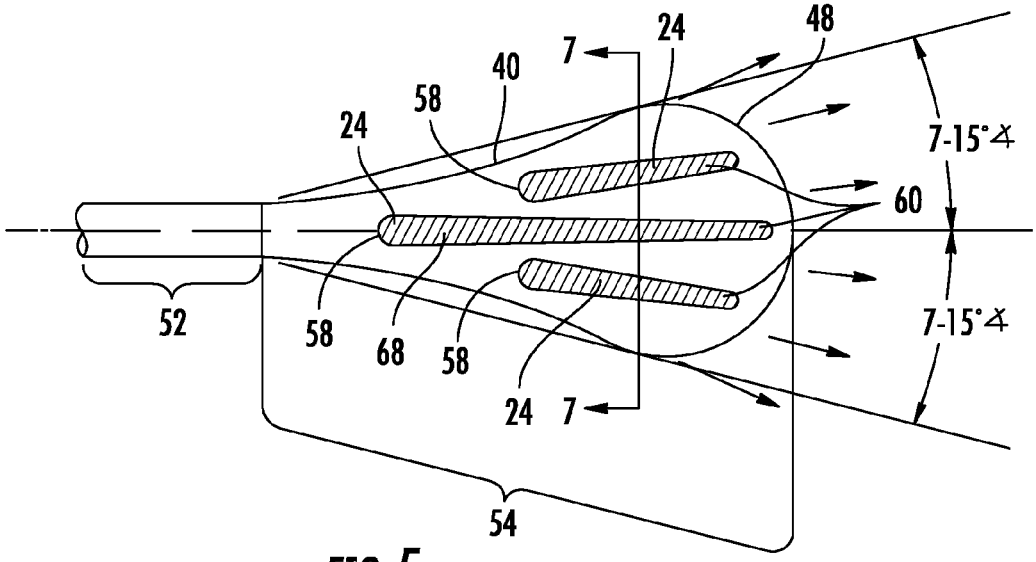
FIG. 5 is a detailed view of the outlet of the diffusion film cooling hole at detail 5-5 is FIG. 4.
Figure 6:
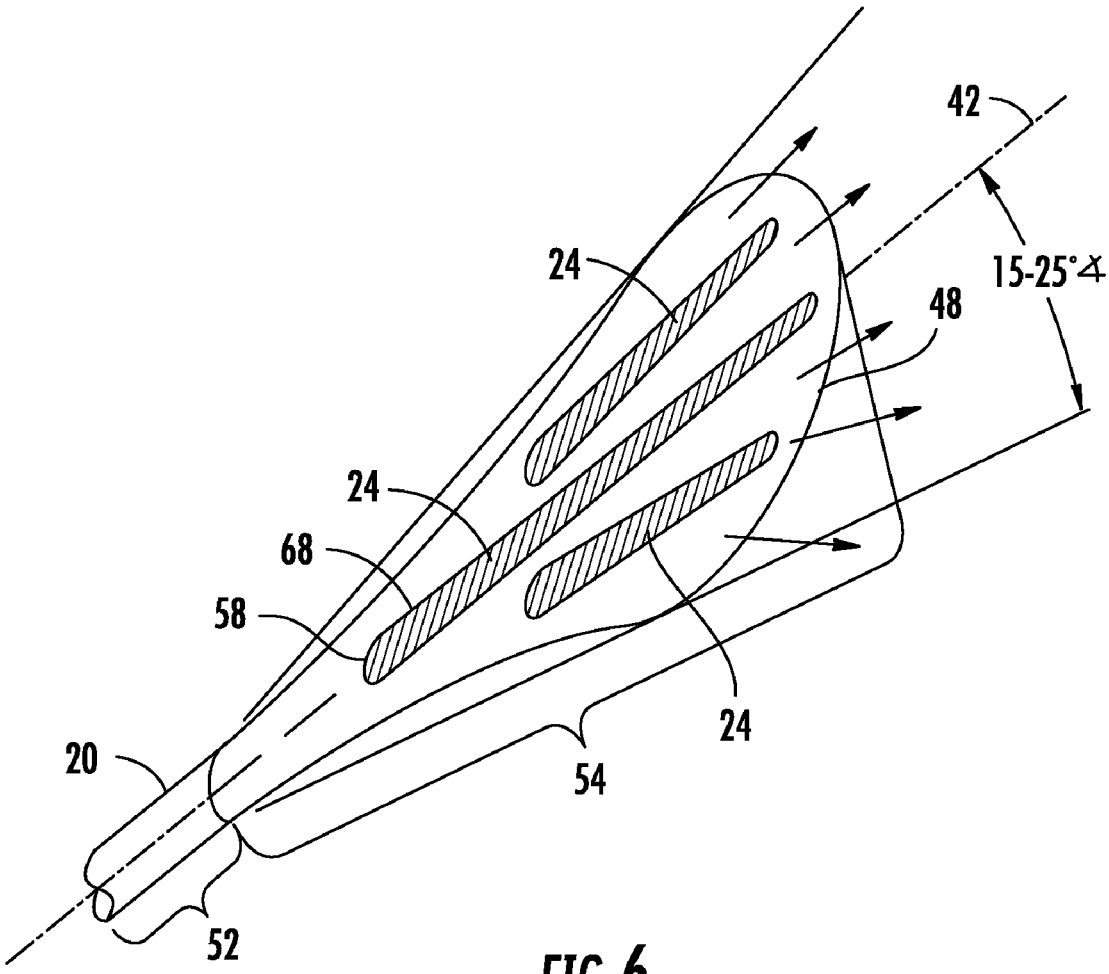
FIG. 6 is a detailed view of the outlet of an alternative configuration of the diffusion film cooling hole at detail 5-5.

The cooling system 10 may include one or more diffusion film cooling holes 20 positioned in the outer wall 16 to provide a cooling fluid pathway between the internal cavity 14 forming the cooling system 10 and an environment outside of the airfoil 12. As shown in FIGS. 4-6, the diffusion film cooling holes 20 may be formed from a first section 52 extending from an inlet 56 into the outer wall 16 and a second section 54 extending from the first section 52 and terminating at an outlet 48 on an outer surface 22 of the outer wall 16. The first section 52 may be used to meter the flow of cooling fluids through the diffusion film cooling hole 20. The first section 52 may have any appropriate cross-sectional configuration. In one embodiment, the first section 52 may have a generally cylindrical cross-section. In another embodiment, the first section 52 may be generally rectangular. The first section 52 may have a constant cross-sectional area through its length. The ratio of length to orthogonal distance of the first section 52 may be between about 1.5:1 to 2.5:1. In embodiments where the first section is cylindrical, the orthogonal distance may be a diameter to form a length to diameter ratio. The second section 54 may have an ever increasing cross-sectional area moving from the first section 52 to the outlet 48 to create a diffusion region.

As shown in FIG. 4, the diffusion film cooling hole 20 may include a first sidewall 40 in the second section 54 having a radius of curvature relative to a longitudinal axis 42 generally aligned with a centerline 44 of cooling fluid flow through the diffusion film cooling hole 20. The diffusion film cooling hole 20 may also include a second sidewall 46 in the second section 54 having a radius of curvature about the axis 42 generally aligned with the centerline 44 of cooling fluid flow through the diffusion film cooling hole 20. The first and second sidewalls 40, 46 may each be positioned at between about 7 degrees and about 15 degrees relative to the longitudinal axis 42 to increase the size of the outlet 48 at the outer surface 22 to decrease the velocity of the cooling fluids. The first and second sidewalls 40, 46 may diverge from the longitudinal axis 42 and from each other to create a larger outlet 48 to create an effective cooling film at the outer surface 22. In this embodiment, as shown in FIG. 5, the longitudinal axis 42 of the diffusion film cooling hole 20 may be generally aligned streamwise with the direction of hot gas flow. As shown in FIG. 4, the diffusion film cooling hole 20 may extend through the outer wall 16 such that the longitudinal axis 42 is positioned nonorthogonally relative to the outer surface 22.

In another embodiment, as shown in FIG. 6, the longitudinal axis 42 of the diffusion film cooling hole 20 may be generally nonparallel and nonorthogonal with a streamwise direction that is aligned the direction of got gas flow. In this embodiment, the first sidewall 40 may be positioned between about 0 degrees and about 7 degrees relative to the longitudinal axis 42, and the second sidewall 46 may be positioned at between about 15 degrees and about 25 degrees relative to the longitudinal axis 42 to increase the size of the outlet 48 at the outer surface 22 to decrease the velocity of the cooling fluids. The first sidewall 40 may be positioned at an angle relative to the longitudinal axis 42 less than the second sidewall 46 because the first sidewall 40 is positioned on the upstream side of the diffusion film cooling hole 20 at which cooling fluid diffusion is hampered by the hot gas flow.

As shown in FIG. 4, an inward surface 50 of the second section 54 may be curved away from the longitudinal axis 52 of the diffusion film cooling hole 20. In one embodiment, the inward surface 50 of the second section 54 may be curved away from the longitudinal axis 42 of the diffusion film cooling hole 20 such that the curved inward surface 50 begins at the first section 52 and an intersection of the inward surface 50 and the outer surface 22 of the outer wall 16 may be positioned between about 15 degrees and about 25 degrees from the longitudinal axis 42. The curved inward surface 50 further increases the size of the outlet 48 shown in FIGS. 5 and 6.

The turbine airfoil cooling system 10 may also include a flow restriction rib 24. The flow restriction rib 24 may be positioned in the second section 54 and may be generally aligned with fluid flow through the diffusion film cooling hole 20. The flow restriction rib 24 may extend from near the first section 52 to the outlet 48. As shown in FIG. 4, the flow restriction rib 24 may not protrude outwardly from the outlet 48, instead, the flow restriction rib 24 may be flush with the outer surface 22. The flow restriction rib 24 may be formed from a plurality of flow restriction ribs 24, as shown in FIGS. 5 and 6. The plurality of flow restriction ribs 24 may be positioned generally beside each other, and a first flow restriction rib 68 may extend closer to the first section 52 than the other flow restriction ribs 24.

Figure 7:
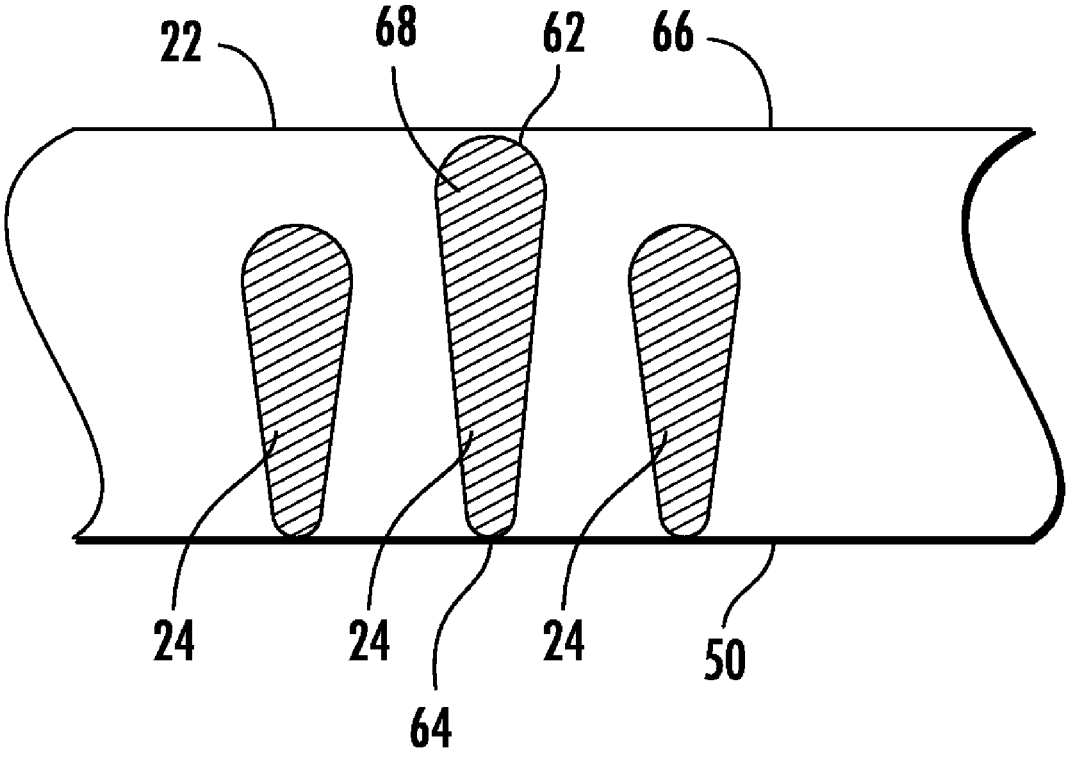
FIG. 7 is a cross-sectional, detailed view of flow restriction ribs taken along section line 7-7 in FIG. 5.
Figure 8:
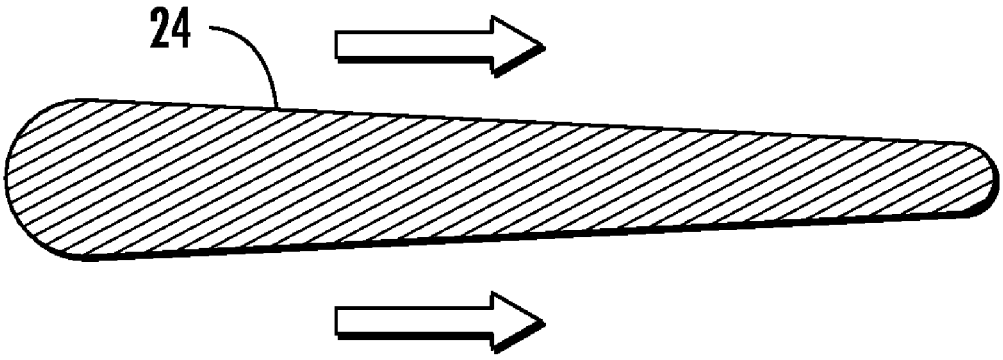
FIG. 8 is a detailed view of a flow restriction rib in FIG. 5.

The flow restriction rib 24 may be tapered, as shown in FIGS. 5, 6 and 8, such that the rib 24 may have a wider leading edge 58 closer to the first section 52 than a trailing edge 60 that is closer to the outlet 48. Such configuration facilitates improved dispersion of the cooling fluids at the outlet 48. In addition, as shown in FIG. 7, the flow restriction rib 24 may be tapered such that the flow restriction rib 24 may have a wider outward edge 62 than inward edge 64. Such configuration reduces the cross-sectional area proximate to the outward surface 66, where traditionally hot air ingestion occurs. Reducing the cross-sectional area at the outward surface 66 reduces the flow path at the outward surface 66, thereby disrupting the hot gas ingestion.

During operation, cooling fluids, such as gases, are passed through the cooling system 10. In particular, cooling fluids may pass into the internal cavity 14, enter the inlet 56 and enter the first section 52 in which the flow of cooling fluids is metered. The cooling fluids then pass into second section 54 and begin to diffuse whereby the velocity of the cooling fluids is reduced. The cooling fluids pass through the openings created by the flow restriction ribs 24 where larger fluid flow occurs proximate to the inward surface 50 than the outward surface 56. As such, the cooling fluids form a more efficient cooling film and invasion into the hot gas flow path is limited. Therefore, the diffusion film cooling hole 20 minimizes film layer shear mixing with the hot gas flow and thus, yields a higher level of cooling fluid effectiveness.

The foregoing is provided for purposes of illustrating, explaining, and describing embodiments of this invention.

Modifications and adaptations to these embodiments will be apparent to those skilled in the art and may be made without departing from the scope or spirit of this invention.

I claim:

1. A turbine airfoil, comprising:

a generally elongated airfoil having a leading edge, a trailing edge and at least one cavity forming a cooling system in the airfoil;

an outer wall forming the generally elongated airfoil and having at least one diffusion film cooling hole positioned in the outer wall and providing a cooling fluid pathway between the at least one cavity forming the cooling system and an environment outside of the airfoil;

wherein the at least one diffusion film cooling hole includes a first section extending from an inlet into the outer wall and a second section extending from the first section and terminating at an outlet on an outer surface of the outer wall;

wherein the second section has an ever increasing cross-sectional area moving from the first section to the outlet; and at least one flow restriction rib positioned in the second section and extending in a direction generally from the first section towards the outlet.

2. The turbine airfoil of claim 1, wherein the at least one flow restriction rib is tapered having a wider leading edge closer to the first section than trailing edge that is closer to the outlet.

3. The turbine airfoil of claim 2, wherein the at least one flow restriction rib is tapered having a wider outward edge than inward edge.

4. The turbine airfoil of claim 1, wherein the at least one flow restriction rib is comprised of a plurality of flow restriction ribs.

5. The turbine airfoil of claim 4, wherein the plurality of flow restriction ribs are positioned generally beside each other and a first flow restriction rib extends closer to the first section than the other flow restriction ribs.

6. The turbine airfoil of claim 4, wherein the first section has a constant cross-sectional area.

7. The turbine airfoil of claim 4, wherein an inward surface of the second section is curved away from a longitudinal axis of the at least one diffusion film cooling hole.

8. The turbine airfoil of claim 7, wherein the inward surface of the second section is curved away from the longitudinal axis of the at least one diffusion film cooling hole such that the curved inward surface begins at the first section and an intersection of the inward surface and the outer surface of the outer wall is positioned between about 15 degrees and about 25 degrees from the longitudinal axis.

9. The turbine airfoil of claim 4, wherein a first side surface of the second section is curved away from a longitudinal axis of the at least one diffusion film cooling hole and a second side surface of the second section that is generally opposite to the first side surface is curved away from the longitudinal axis of the at least one diffusion film cooling hole.

10. The turbine airfoil of claim 9, wherein the first side surface of the second section is curved away from the longitudinal axis of the at least one diffusion film cooling hole such that the curved first side surface begins at the first section and an outermost point of the first side surface is positioned between about 7 degrees and about 15 degrees from the longitudinal axis, and wherein the second side surface of the second section is curved away from the longitudinal axis of the at least one diffusion film cooling hole such that the curved first side surface begins at the first section and an outermost point of the second side surface is positioned between about 7 degrees and about 15 degrees from the longitudinal axis.

11. The turbine airfoil of claim 9, wherein the first side surface of the second section is curved away from the longitudinal axis of the at least one diffusion film cooling hole such that the curved first side surface begins at the first section and an outermost point of the first side surface is positioned between about 0 degrees and about 7 degrees from the longitudinal axis, and wherein the second side surface of the second section is curved away from the longitudinal axis of the at least one diffusion film cooling hole such that the curved first side surface begins at the first section and an outermost point of the second side surface is positioned between about 15 degrees and about 25 degrees from the longitudinal axis.

12. The turbine airfoil of claim 1, wherein a ratio of length to orthogonal distance of the first section is between about 1.5:1 to 2.5:1.

13. A turbine airfoil, comprising:

a generally elongated airfoil having a leading edge, a trailing edge and at least one cavity forming a cooling system in the airfoil;

an outer wall forming the generally elongated airfoil and having at least one diffusion film cooling hole positioned in the outer wall and providing a cooling fluid pathway between the at least one cavity forming the cooling system and an environment outside of the airfoil;

wherein the at least one diffusion film cooling hole includes a first section extending from an inlet into the outer wall and a second section extending from the first section and terminating at an outlet on an outer surface of the outer wall;

wherein the second section has an ever increasing cross-sectional area moving from the first section to the outlet; and at least one flow restriction rib positioned in the second section, extending in a direction generally from the first section towards the outlet and tapered by having a wider outward edge than inward edge.

14. The turbine airfoil of claim 13, wherein the at least one flow restriction rib is tapered having a wider leading edge closer to the first section than trailing edge that is closer to the outlet.

15. The turbine airfoil of claim 14, wherein the at least one flow restriction rib is comprised of a plurality of flow restriction ribs and wherein the plurality of flow restriction ribs are positioned generally beside each other and a first flow restriction rib extends closer to the first section than the other flow restriction ribs.

16. The turbine airfoil of claim 15, wherein an inward surface of the second section is curved away from a longitudinal axis of the at least one diffusion film cooling hole such that the curved inward surface begins at the first section and an intersection of the inward surface and the outer surface of the outer wall is positioned between about 15 degrees and about 25 degrees from the longitudinal axis.

17. The turbine airfoil of claim 13, wherein a first side surface of the second section is curved away from a longitudinal axis of the at least one diffusion film cooling hole and a second side surface of the second section that is generally opposite to the first side surface is curved away from the longitudinal axis of the at least one diffusion film cooling hole.

18. The turbine airfoil of claim 17, wherein the first side surface of the second section is curved away from the longitudinal axis of the at least one diffusion film cooling hole such that the curved first side surface begins at the first section and an outermost point of the first side surface is positioned between about 7 degrees and about 15 degrees from the longitudinal axis, and wherein the second side surface of the second section is curved away from the longitudinal axis of the at least one diffusion film cooling hole such that the curved first side surface begins at the first section and an outermost point of the second side surface is positioned between about 7 degrees and about 15 degrees from the longitudinal axis.

19. The turbine airfoil of claim 17, wherein the first side surface of the second section is curved away from the longitudinal axis of the at least one diffusion film cooling hole such that the curved first side surface begins at the first section and an outermost point of the first side surface is positioned between about 0 degrees and about 7 degrees from the longitudinal axis, and wherein the second side surface of the second section is curved away from the longitudinal axis of the at least one diffusion film cooling hole such that the curved first side surface begins at the first section and an outermost point of the second side surface is positioned between about 7 degrees and about 15 degrees from the longitudinal axis.

20. A turbine airfoil, comprising:

a generally elongated airfoil having a leading edge, a trailing edge and at least one cavity forming a cooling system in the airfoil;

an outer wall forming the generally elongated airfoil and having at least one diffusion film cooling hole positioned in the outer wall and providing a cooling fluid pathway between the at least one cavity forming the cooling system and an environment outside of the airfoil;

wherein the at least one diffusion film cooling hole includes a first section extending from an inlet into the outer wall and a second section extending from the first section and terminating at an outlet on an outer surface of the outer wall;

wherein the second section has an ever increasing cross-sectional area moving from the first section to the outlet; and at least one flow restriction rib positioned in the second section and extending in a direction generally from the first section towards the outlet;

wherein the at least one flow restriction rib includes a compound taper such that the at least one flow restriction rib has a wider outward edge than inward edge and has a wider leading edge closer to the first section than trailing edge that is closer to the outlet.

* * * * *